United States Patent [19]

Herrig et al.

[11] 4,124,183

[45] Nov. 7, 1978

[54] ROLL OF WIRE MESH OF THE CHAIN-LINK FENCING TYPE

[75] Inventors: Klaus Herrig; Heinz Wagner, both of St. Ingbert, Germany

[73] Assignee: Acieries Reunies de Burbach-Eich-Dudelange S.A. Arbed, Luxembourg, Luxembourg

[21] Appl. No.: 848,322

[22] Filed: Nov. 3, 1977

[30] Foreign Application Priority Data

Nov. 4, 1976 [DE] Fed. Rep. of Germany ..... 26506149

[51] Int. Cl.[2] ..... B21F 29/00

[52] U.S. Cl. ..... 245/6; 140/107; 206/412

[58] Field of Search ..... 140/3 R, 92.3, 92.4, 140/92.7, 107, 9; 256/32, 45; 206/389, 412; 242/55; 245/2, 6

[56] References Cited

U.S. PATENT DOCUMENTS

| | | | |
|---|---|---|---|
| 795,529 | 7/1905 | Mafera | 245/6 |
| 1,329,189 | 1/1920 | Knaur | 256/45 |
| 1,756,396 | 4/1930 | Spicer | 206/412 |
| 3,473,652 | 10/1969 | Verstraete | 206/389 |
| 4,049,224 | 9/1977 | Wener et al. | 245/6 |

*Primary Examiner*—Lowell A. Larson
*Attorney, Agent, or Firm*—Karl F. Ross

[57] ABSTRACT

Chain-link fencing reticulated wire mesh having square or rhomboidal mesh and formed from wire spirals which are interengaged is rolled in a compact roll with the aid of at least one and up to three elongated elements or binding strands which extend in troughs of the successive spirals and assist in drawing them together so that each flattened spiral is twisted sharply out of the plane of the web of the mesh and enables the roll to be extremely compact.

9 Claims, 3 Drawing Figures

ROLL OF WIRE MESH OF THE CHAIN-LINK FENCING TYPE

FIELD OF THE INVENTION

The present invention relates to a tightly coiled roll of a reticulated web of wire mesh, namely, a reticulated array of substantially square meshes formed by interengaged flattened spirals and, more particularly, a web of chain-link fencing as is commonly used for enclosures.

BACKGROUND OF THE INVENTION

In the manufacture of chain-link fencing and, more generally, long webs of wire mesh, it is known to feed a wire through a machine provided with a worm and mesh blade to form flattened spirals having a pitch angle of about 45°, and to cause the advancing spiral to engage in a previously formed spiral. When the length of each spiral is the width of the desired web or fence, the spiral is cut off, the mesh is advanced and the process is repeated.

At the free ends of the spirals and, therefore, the opposite edges of the mesh, adjacent spirals have their wires bent over one another or twisted together to hold them in place. The result is a mesh structure in which each mesh has a substantially square or rectangular configuration. If the pitch angle of the spirals are different from 45°, the configuration is that of a rhombus.

Commercial wire mesh webs of the aforedecribed type, according to German Industrial Standard DIN 1199 have a mesh or web width of 2 mm or more and meshes of 10 to 150 mm on a side. The wire diameter may be 1.4 to 3.4 mm and a standard length of the web is 25 m. The web is marketed in the form of a roll or coil and the grid thus produced can be galvanically or otherwise protected against corrosion. Usually, the wires are galvanically plated or are provided with a plastic coating for this purpose.

In accordance with a conventional process, the web is coiled without a core in a stretched state. The resulting roll has the disadvantage that it is not especially compact and relative to the coiled length, requires considerable storage and transport space. This is a consequence of the fact that the stretched web prevents the zigzag-shaped wire spirals of the individual wires from extending deeply one within another.

It has previously been proposed to provide a roll of screening of this type in which the individual wire spirals are compacted together in the plane of the web during the coiling and under the influence of the weight of the individual spirals. In other words, the successive spirals shift together and increase the packing density. The outer turn of the coil is wound in a stretched state to increase the stability of the roll.

While such a roll has a greater compactness than the roll previously descirbed so that it occupies less space during storage and transport, it is incapable of achieving the optiumum packing density because the sucessive wire sprirals lie generally tangential to the roll surface.

A disadvantage common to both of the aforedescribed processes is that the successive turns of the web are easily shiftable relative to one another axially and thus the rolls have low stability with respect to handling.

Especially with the last-mentioned coiling technique, it is found that the rolls can only be uncoiled with difficulty because the twisted together or bent over ends of the wire spirals easily unhook or bind.

OBJECT OF THE INVENTION

It is the principal object of the present invention to provide a hihgly compact roll of a wire mesh or screen of the aforedescribed type which can achieve an optimum packing density with good stability and without difficulties during uncoiling of the roll.

SUMMARY OF THE INVENTION

This object is achieved by a technique which has been found, quite surprisingly, to permit an optimum packing density to be attained. According to the invention, the wire spirals of the entire mesh web are so tightly shifted together that they are twisted sharply out of the plane of the web. When the web is formed with at least one and up to three binding strands which extend between the strips lying tightly against one another and formed from the wire spirals which have been shifted into one another tightly, the desired result is obtained. The binding strand can be a cord, string, rope, cable, wire or band and the binder material can be composed of metal or natural fibers or synthetic resin.

The packing density of such a roll, in which the spiral orientation angle, i.e. the angle between the plane of the flattened spiral and an axial plane through the roller core include an angle of 15° (as opposed to 90° in the case of a stretched web) is optimum. This corresponds to a twisting of the spiral plane relative to the plane of the flattened web of 75° as opposed to 0°. The saving in storage and transport volume amounts to about 70% by comparison with a roll formed from the stretched wire mesh web and over 40% by comparison with a roll made by the prior art system for compacting the wire spirals.

The bedding of the undulating layers together gives an optimum packing density with the additional advantage that the crests and troughs of the successive undulating layers are aligned and fitted together so that special means is not required to prevent the relative axial sliding of the layers.

The outer surface of the completed compact roll shows the typical zigzag pattern resulting from the fact that the spirals lie practically in axial planes of the roll. At the center of the latter, the roll has a substantially concave waist because the material fits together most effectively in this region while, at the ends of the roll, because of the bent-over portions at the free extremities of each spiral, the roll has a somewhat expanded diameter.

During the manufacture of the wire mesh web, the binding strands, fastened to the wire spirals which are to form the core of the roll, are disposed loosely between the wire spirals along the same troughs of the undulations in a continuous manner. When the strands are drawn tight, they swing the spirals into the positions described. Thus the strands can be shorter than the stretched condition of the web.

For a web width of the usual commercial magnutude, i.e. 0.5 to 2.0m, one to three binder strands are provided. The ends of the binder strands can hang freely from the roll and have been found to facilitate an unrolling of the web. The roll may be tied by any conventional bands and upon the release of the latter, it is merely necessary to pull upon the binder strands and unroll the coil. Surprisingly, the coil unrolls without a binding of the twisted ends of the spirals and without an axial relative displacement of successive coils. The web has been found to pass into the stretched state with relative ease.

BRIEF DESCRIPTION OF THE DRAWING

The above and other objects, features and advantages of the present invention will become more readily apparent from the following description, reference being made to the accompanying drawing in which.

SPECIFIC DESCRIPTION

While a conventional mesh roll is substantially cylindrical and has approximately straight-line generatrices, the square and/or rhomboidal mesh can be viewed on the surface. The roll according to the invention, however, represented at 1 has a zigzag surface because of the approximately parallel wire spirals which interfit in the manner described.

The diameter of the roll is smaller at the center than at the ends for the reasons described previously. In a trough in the region of each of the roll ends, there is provided a cord 2 whcih is fastened to the roll core and extends over the entire mesh web. The securing of the roll after it has been coiled and retention of the compact configuration is effected by separate metal wires 3 which encircle the roll.

For a standard length of 25 mm and a square-mesh chain-link fence web having wire of a diameter of 2.8 mm coated with plastic, a mesh width of 50 mm and an average diameter of the roll of 30 cm as measured at the crests, the diameter at the troughs is about 6 cm smaller. The height or length of the roll can be 0.5 to 2 m. The storage of such rolls with the zigzag peripheries interfitted has been found to reduce the effective roll diameter to 27 mm when a stack of such rolls is stored. In other words, the center-to-center spacing of adjacent rolls is about 27 cm.

Figure 1:
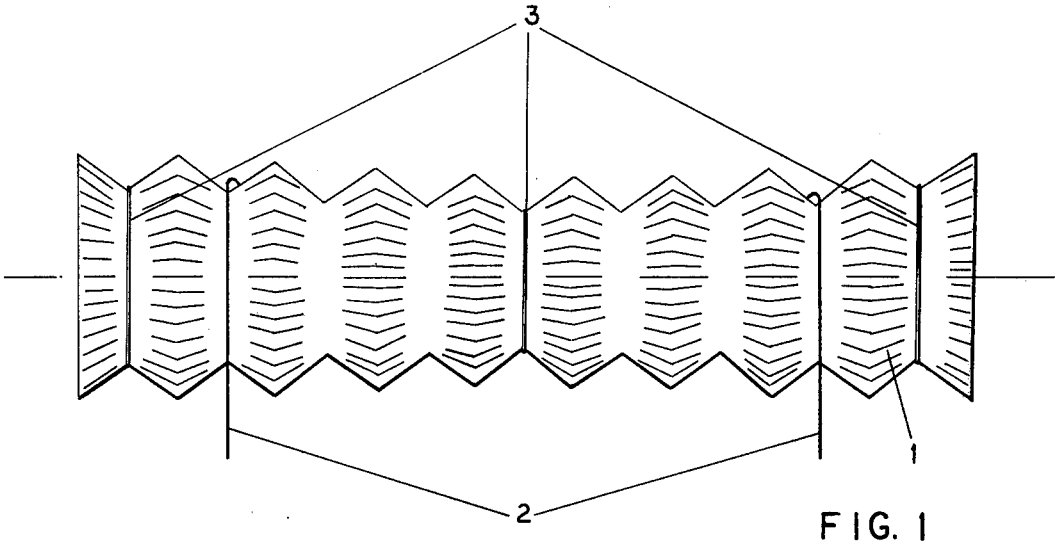
FIG. 1 is a diagrammatic elevational view from the side of a roll fabricated in accordance with this invention.
Figure 2:
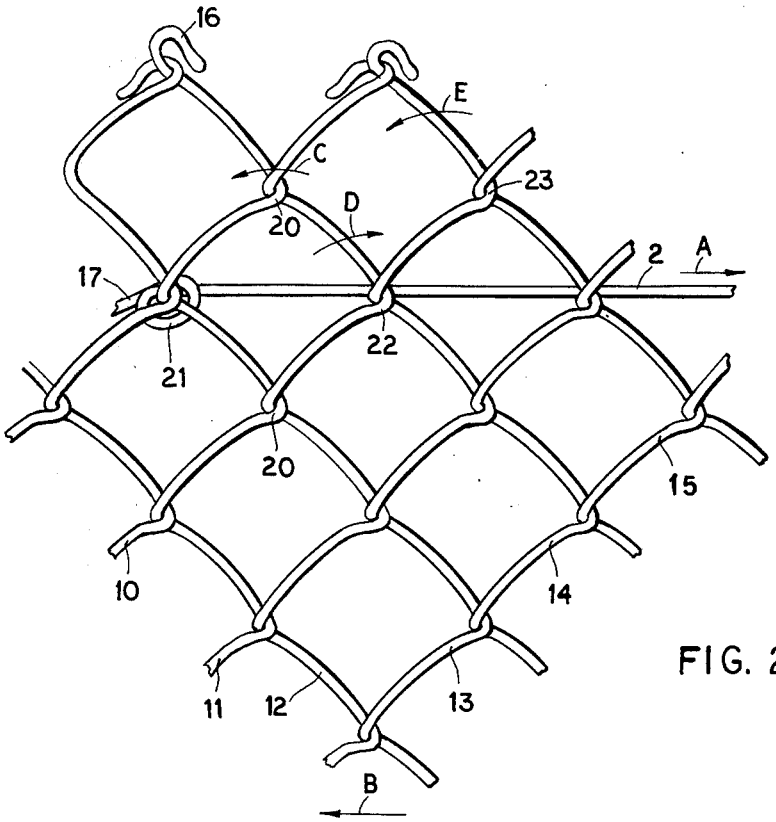
FIG. 2 is a view of the chain-link mesh showing the relationship of one of the binding strands therewith.

As can be seen from FIG. 2, the mesh can be composed of successive spirals 10, 11, 12, 13, 14, 15, etc., the free ends of the spirals being hooked together at 16.

The strand 2 is affixed by knotting at 17 to the spirals 10 and 11 adapted to form the core of the coil. By tension on the strand 2 in the direction of arrow A and a relative movement of the mesh web in the direction of arrow B, the spiral 11 tends to swing in the direction of the arrow C to raise the crests 20 relative to the trough 21, thereby swinging the spiral practically perpendicular to the plane of the paper. The spiral 12, however, swings in the opposite sense D so that its troughs 22 swing downwardly and toward the troughs 21 while the crests 23 of spiral 13 again swing upwardly in the direction of arrow E. As a result, the successive spirals are brought tightly together and, upon coiling, are inclined only by about 15° to axial planes of the coil.

Figure 3:
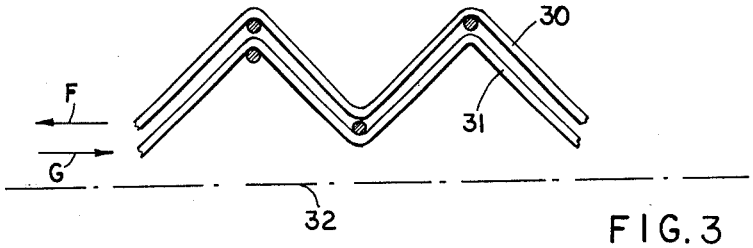
FIG. 3 is another diagram illustrating the invention.

The successive turns or layers of the coil represented at 30 and 31 in FIG. 3 in which they are shown diagrammatically with respect to the coil axis 32, interfit, i.e. the crests coincide with crests and the troughs with troughs, so that axial displacement in the direction of arrow F or G is precluded.

The roll described above can be made by the method and with the apparatus described in our concurrently filed and copending application Ser. No. 848,324.

We claim:

1. A roll of a wire-mesh web formed from successive interengaged generally spiral wires with adjacent flattened spirals interconnected along opposite edges of the web, said roll having the spirals tightly drawn together and sharply bent out of the plane of the web, said roll being provided with at least one and up to three binder strands each binder strand extending between the wire spirals drawn tightly together.

2. The roll defined in claim 1 wherein said binder strand is a wire, cord, rope, cable, string, or band of metal, natural fiber or synthetic resin.

3. The roll defined in claim 1 in which each of said spirals has a plane including an angle with an axial plane of the roll of about 15°.

4. The roll defined in claim 1 having a zigzag upper surface and a diameter at the center of the roll which is smaller than the diameter at the ends of the roll.

5. The roll defined in claim 1 wherein two such strands are provided, each lying along a respective trough of the roll.

6. The roll defined in claim 5 having a height of 0.5 to 2.00 m.

7. The roll defined in claim 6 which is constituted of chain-link fence material.

8. The roll defined in claim 7 wherein the wire mesh is composed of plastic-coated wire.

9. The roll defined in claim 7 further comprising a plurality of ties extending around said roll for retaining same in a compact state.

* * * * *